US005465512A

United States Patent [19]

Livesay et al.

[11] Patent Number: 5,465,512

[45] Date of Patent: Nov. 14, 1995

[54] IMPLEMENT ASSEMBLY WITH A MECHANICALLY ATTACHED ADAPTER

[75] Inventors: Richard E. Livesay, Peoria; Nathan G. Rozenboom, Metamora; Frederick J. Shane, Peoria, all of Ill.

[73] Assignee: Caterpillar Inc., Peoria, Ill.

[21] Appl. No.: 266,807

[22] Filed: Jun. 28, 1994

[51] Int. Cl.[6] ..... E02F 9/28

[52] U.S. Cl. ..... 37/457; 37/455

[58] Field of Search ..... 37/452, 453, 454, 37/455, 456, 457, 458; 172/123, 699, 701.2, 713, 719, 749, 751, 753; 299/91, 92; 403/355, 379

[56] References Cited

U.S. PATENT DOCUMENTS

| | | | |
|---|---|---|---|
| 3,572,785 | 3/1971 | Larson | 287/103 |
| 3,722,932 | 3/1973 | Dougall | 37/457 X |
| 3,774,324 | 11/1973 | Laford | 37/457 |
| 4,231,173 | 11/1980 | Davis | 37/457 |
| 4,267,653 | 5/1981 | Hahn et al. | 37/457 |
| 4,271,615 | 6/1981 | Jones | 37/458 |
| 4,282,665 | 8/1981 | Fletcher et al. | 37/142 A |
| 4,413,432 | 11/1983 | Bierwith | 37/142 A |
| 4,980,980 | 1/1991 | Schadov et al. | 37/452 |
| 5,134,793 | 8/1992 | Bierwith | 37/458 |
| 5,331,754 | 7/1994 | Ruvang | 37/457 |

*Primary Examiner*—Eric K. Nicholson
*Assistant Examiner*—Robert Pezzuto
*Attorney, Agent, or Firm*—O. Gordon Pence; J. W. Burrows

[57] ABSTRACT

Implement assemblies have previously used mechanically attached adapters that are secured to the base edge by bolts and/or other wedging type mechanisms. In these known implement assemblies, the wedge member has a tendency, during use, to become loose and fall out which allows the adapter to fall off of the base edge. In the subject arrangement, a clamp member is disposed in a longitudinally extending opening of an upper strap of an adapter and a wedge member is forcibly driven into the assembly such that the wedge member is disposed between the clamp member and the adapter to effectively secure the upper strap in intimate engagement with a mounting portion of an implement. At the same time, a resilient pad member is disposed between the adapter and the wedge member which effectively biases the adapter into intimate contact with the mounting portion of the implement. This arrangement allows both the wedge member and the clamp member to move in conjunction with the adapter, thus, eliminating if not reducing any tendency of the wedge member to become loose and fall out.

8 Claims, 4 Drawing Sheets

Fig. 5
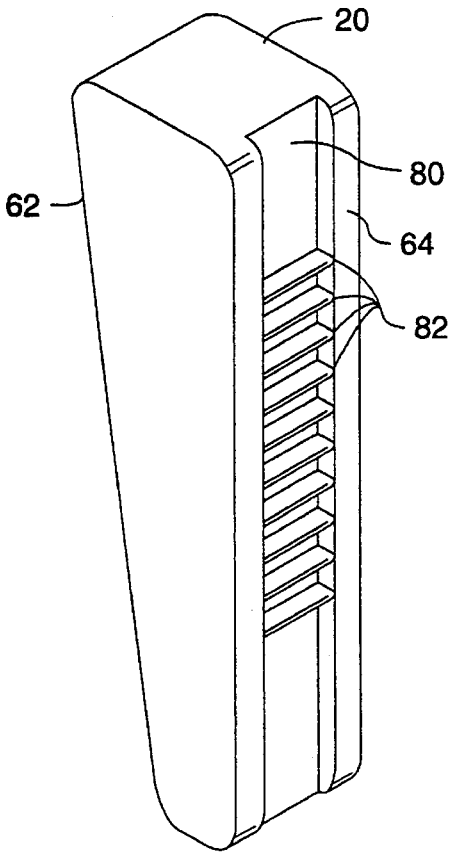
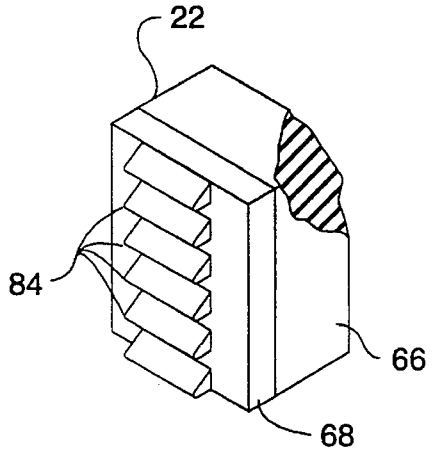
Fig. 6
Fig. 7
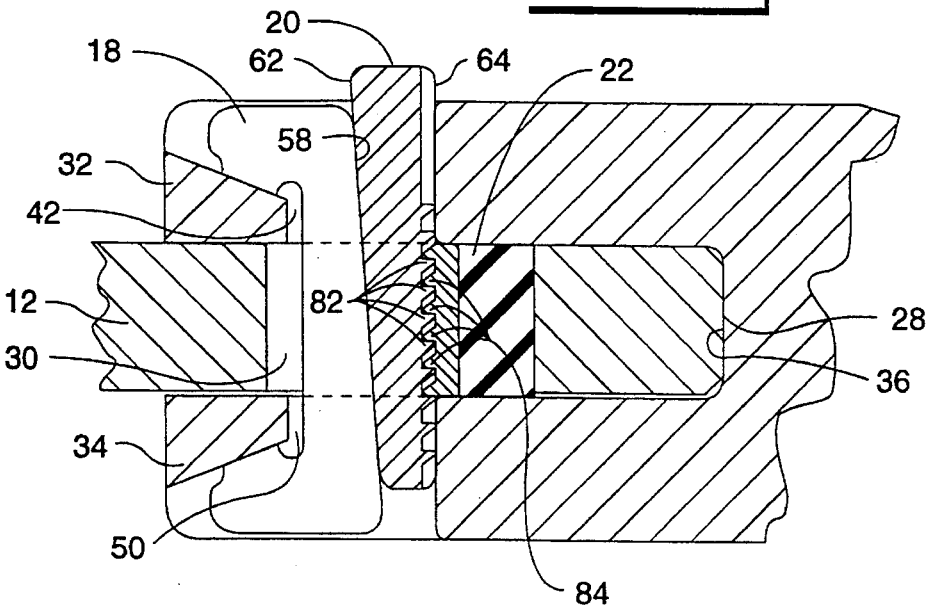

IMPLEMENT ASSEMBLY WITH A MECHANICALLY ATTACHED ADAPTER

TECHNICAL FIELD

This invention relates generally to an earthworking implement assembly and more particularly to an implement assembly with a mechanically attached adapter.

BACKGROUND ART

Many implement assemblies have adapters secured to a base edge of the implement in various ways. In many of the implement assemblies, the adapter is secured to the base edge of the implement by welding the adapter to the base edge. In other implement assemblies, the adapter is bolted to the base edge. In these implement assemblies, it is many times difficult to obtain a sufficient torque on the bolt to properly secure the adapter to the base edge. Even if sufficient torque can be achieved, it is many times difficult to remove the bolts when wanting to replace the worn out adapter. In some applications, the adapter is mechanically secured to the base edge assembly by utilizing a clamping assembly that is held in place by a tapered wedge. In these applications, the clamp secures the straps of the adapter to the base edge and at the same time secures the leading portion of the base edge against the bottom of a slot in the adapter. The wedge utilized in these applications transfers a force between the front portion of a slot in the base edge of the assembly to the clamping member and, subsequently, to the straps on the adapter. Since the clamping force is being transferred from the base edge to the clamping member, any motion of the adapter relative to the base edge is transferred through the wedge and clamping member, thus, many times causing the wedge member to become loose and possibly fall out, thus, losing the clamping force. It has been necessary to provide various forms of wedge retainers to attempt to maintain the wedge in its load transferring position. However, it has been found that many times the wedge has been secured in its clamping position by welding the wedge to the clamp. Consequently, in order to remove the wedge and clamp, it is necessary to burn off the weld which is time consuming and detrimental to the components.

The present invention is directed to overcoming one or more of the problems as set forth above.

DISCLOSURE OF THE INVENTION

In one aspect of the present invention, an implement assembly with a mechanically attached adapter is provided and includes an implement having a mounting portion with an upper surface, a lower surface, a leading edge surface, and a vertically oriented longitudinally extending slot defined therein spaced rearwardly from the leading surface. The implement assembly also includes an adapter having an upper strap, a spaced apart lower strap having a force transferring surface thereon, and an inner connected abutment surface. The upper and lower straps of the adapter being adapted to receive the mounting portion therebetween. The upper strap has a generally flat surface on one side thereof and a vertically oriented longitudinally extending opening defined therein. A first surface is disposed on the upper strap of the adapter at one end of the opening and oriented at an acute angle with respect to the generally flat surface and a second surface is disposed at the other end of the longitudinally extending opening. A clamp member is also provided and disposed in the vertically oriented longitudinally extending opening and has a first surface thereon that matingly engages the surface disposed on the upper strap at the one end of the opening. The clamp member also includes a second opposed surface. The implement assembly further includes a resilient pad member disposed in the forward end of the longitudinally extending slot between the upper and lower straps of the adapter. A wedge member is also provided and has a first surface operative to matingly engage the second opposed surface of the clamping member. A second surface is disposed on the wedge member spaced from and angled with respect to the first surface and operative to contact and compress the resilient pad member during assembly to securely retain the interconnecting abutment surface in engagement with the leading surface of the mounting portion. The second surface of the wedge member also contacts the second surface of the longitudinally extending opening in the upper surface and the force transferring surface on the lower strap.

The present invention provides an implement assembly having a mechanically attached adapter wherein the force needed to secure the strap of the adapter securely to the mounting portion of the implement is obtained by the wedge member being secured between the ends of the longitudinally extending opening in the adapter and the clamping member. The adapter is held in intimate contact with the leading surface of the mounting portion of the implement by the force of the resilient pad acting between the wedge member and the forward side of the longitudinally extending slot in the mounting portion of the implement. Consequently, in the subject arrangement any relative movement between the adapter and the mounting portion of the implement does not affect the clamping force between the wedge member and the clamp member since they are both moving in conjunction with any movement of the adapter. Therefore, there is no tendency for the wedge member to work loose during normal operation of the implement assembly.

BRIEF DESCRIPTION OF THE DRAWINGS

FIG. 5 is a diagrammatic representation of an alternate embodiment of the wedge member generally illustrated in FIGS. 1 and 3;

FIG. 6 is an alternate embodiment of a resilient pad member that is generally illustrated in FIGS. 1 and 3;

FIG. 7 is a sectional view like that of FIG. 2 but utilizing the wedge member and resilient pad member illustrated in FIGS. 5 and 6;

BEST MODE FOR CARRYING OUT THE INVENTION

Figure 1:
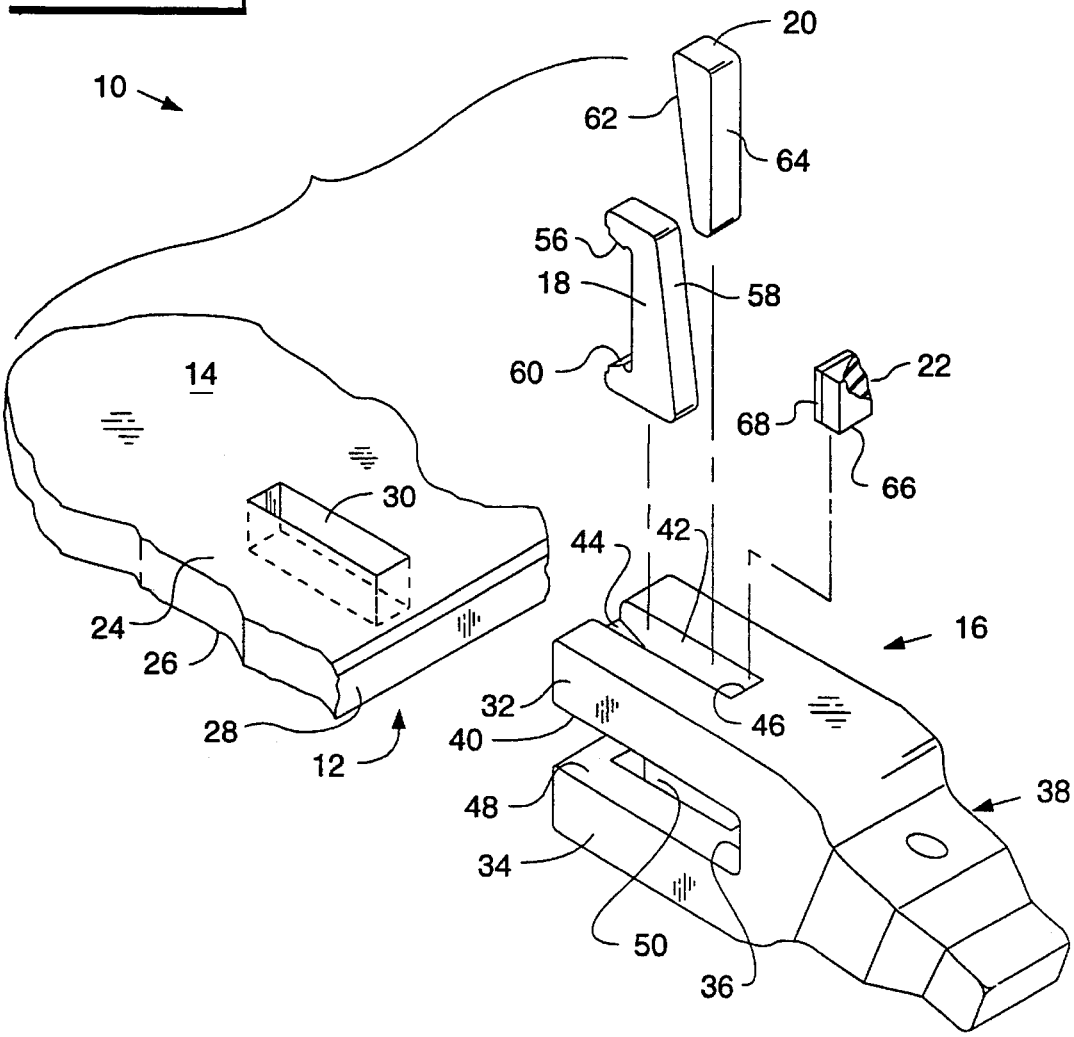
FIG. 1 is a diagrammatic representation of an implement assembly illustrating all of the elements in their unassembled condition.
Figure 2:
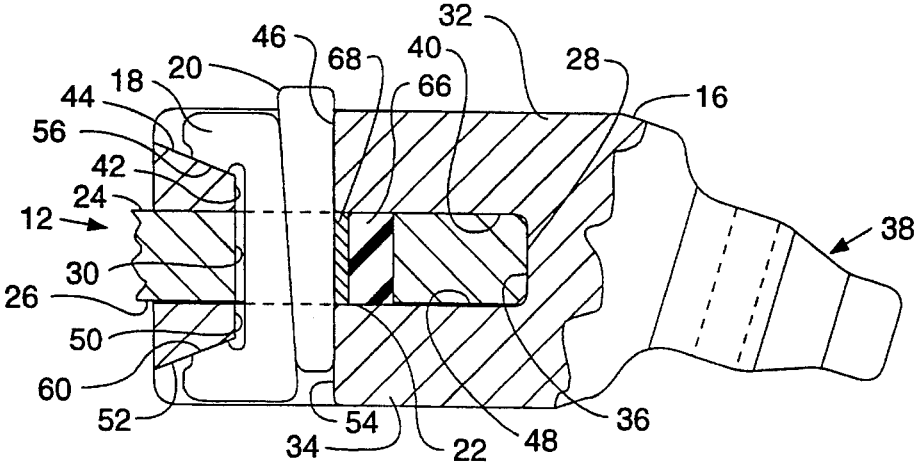
FIG. 2 is a sectional view of the implement assembly of FIG. 1 with all of the elements in their assembled condition.

Referring to the drawings, and more particularly to FIGS. 1 and 2, an implement assembly 10 is illustrated and includes a mounting portion 12 of a portion of an implement 14, an adapter 16, a clamp member 18, a wedge member 20, and a resilient pad member 22. The mounting portion 12 has an upper surface 24, a lower surface 26, a leading surface 28 and a vertically oriented longitudinally extending slot 30. The longitudinally extending slot 30 is spaced rearwardly from the leading surface 28.

The adapter 16 has an upper strap 32, a lower strap 34 spaced from the upper strap 32, an interconnecting abutment surface 36 interconnecting the upper strap 32 and the lower strap 34 and a nose portion 38. The nose portion 38, in a well-known manner is adapted to receive a ground engaging tip (not shown). It is recognized that instead of having a nose portion 38, the tip could be integrally formed in place of the nose portion 38.

The upper strap 32 has a generally flat surface 40 on the side thereof adjacent the upper surface 24 of the mounting portion 12 and a vertically oriented longitudinally extending opening 42 defined therein. A first surface 44 is disposed on the upper strap 32 at one end of the longitudinally extending opening 42 and oriented at an acute angle with respect to the generally flat surface 40 thereon. A second surface 46 is disposed on the upper strap 32 at the other end of the longitudinally extending opening 42.

The lower strap 34 has a generally flat surface 48 on the side thereof generally adjacent the lower surface 26 of the mounting portion 12 and a vertically oriented longitudinally extending opening 50 defined therein. A first surface 52 is disposed on the lower strap 34 at one end of the longitudinally extending opening 50 and oriented at an acute angle with respect to the generally flat surface 48 thereof. A force transferring surface 54 is disposed on the lower strap 34 at the other end of the longitudinally extending opening 50 thereof.

The clamp member 18 has a first surface 56 that engages the first surface 44 on the upper strap 32 and includes a second opposed surface 58. The clamp member 18 is disposed in the longitudinally extending opening 42 of the upper strap 32 and extends through the longitudinally extending slot 30 of the mounting portion 12 and into the longitudinally extending opening 50 of the lower strap 34. A third surface 60 is disposed on the clamp member 18 spaced from the first surface 56 and opposed to the second surface 58 and operative to engage the first surface 52 at the one end of the longitudinally extending opening 50 on the lower strap 34.

The wedge member 20 has a first surface 62 operative to engage the second opposed surface 58 of the clamp member 18 and a second surface 64 spaced from and angled with respect to the first surface 62 thereof.

The resilient pad member 22 is disposed in the forward portion of the longitudinally extending slot 30 of the mounting portion 12. The resilient pad member 22 as illustrated in FIGS. 1 and 2 has an elastomeric portion 66 and a non-resilient portion 68. It is recognized, that the non-resilient portion 68 could be omitted without departing from the essence of the invention. Likewise, it is recognized that the elastomeric portion 66 could be made of various types of elastomeric material without departing from the essence of the invention.

Figure 3:
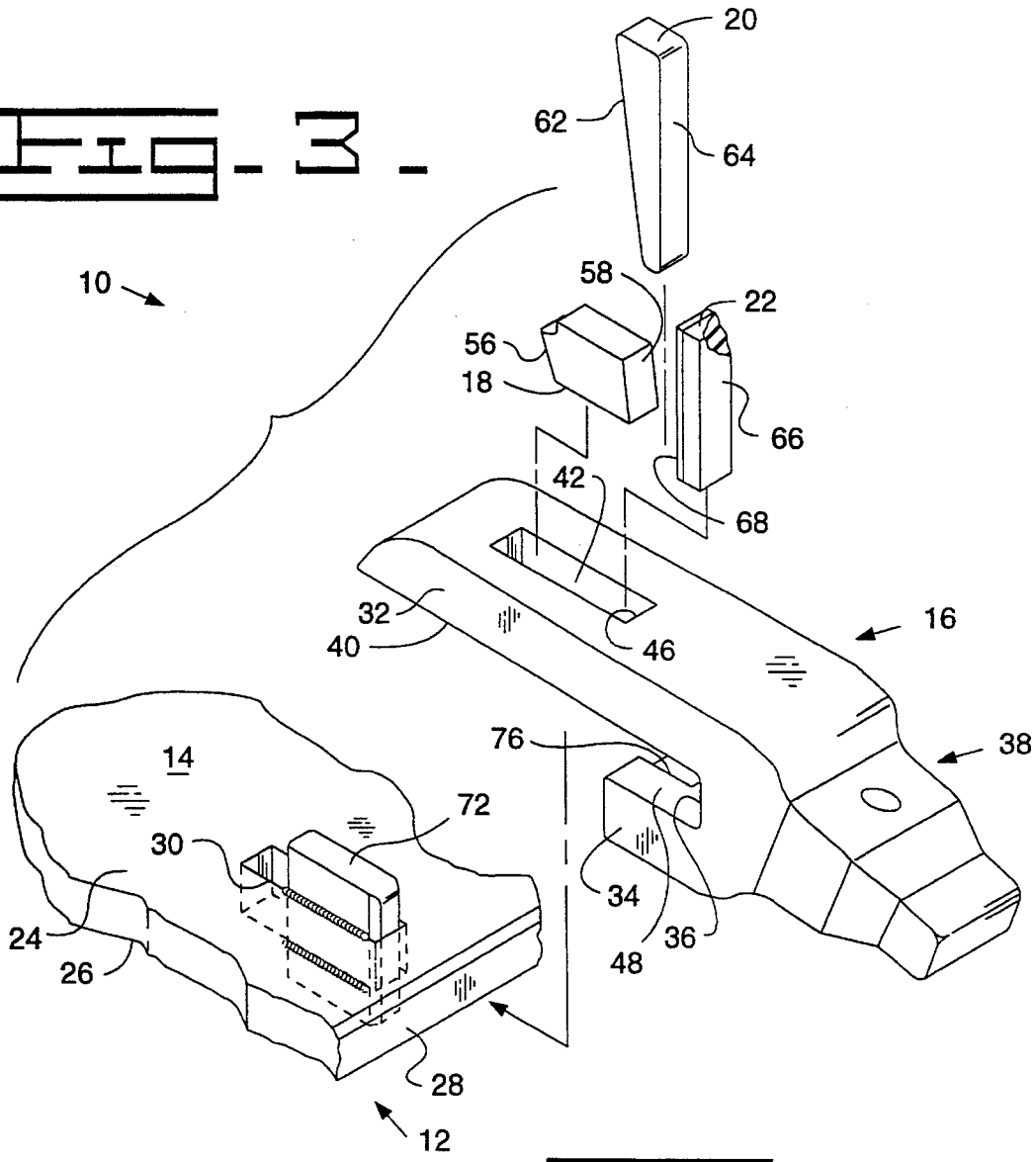
FIG. 3 is a diagrammatic representation of an alternate embodiment of the implement assembly illustrating all of the elements in their unassembled condition.
Figure 4:
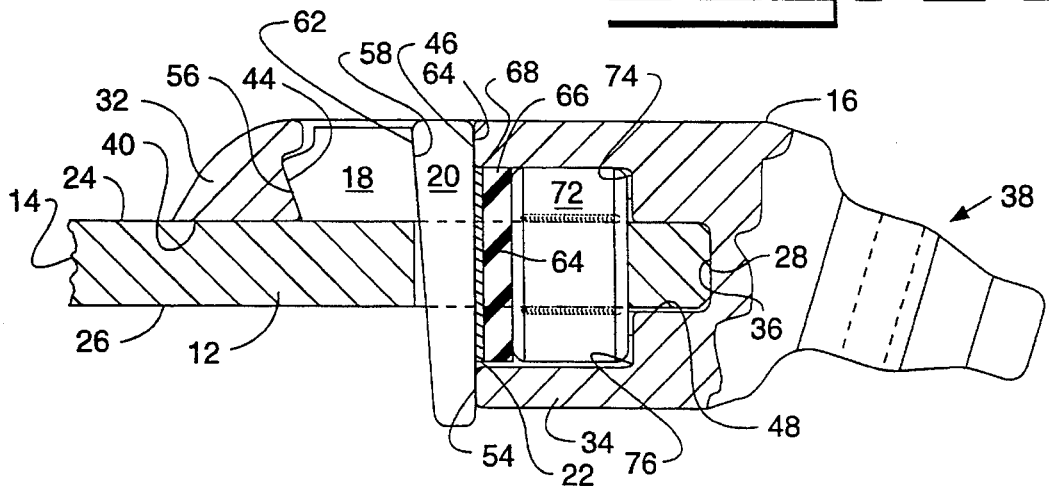
FIG. 4 is a sectional view of the implement assembly of FIG. 3 with all of the elements in their assembled condition.

Referring to FIGS. 3 and 4, another embodiment of the implement assembly 10 is illustrated. All like elements have like element numbers. The mounting portion 12 of the implement 14 has the upper surface 24, the lower surface 26, the leading surface 28, and the vertically oriented, longitudinally extending slot 30 that is spaced rearwardly from the leading surface 28. In the subject arrangement, an abutment member 72 is disposed in the forward end portion of the longitudinally extending slot 30 and extends upwardly from the upper surface 24 and downwardly from the lower surface 26. The upper strap 32 has a groove 74 defined therein on the side thereof adjacent the generally flat surface 40 and located forwardly of the longitudinally extending opening 42 therein.

The lower strap 34 extends rearwardly from the interconnecting abutment surface 36 and terminates at a location that is generally in line with the forward end of the longitudinally extending opening 42 in the upper strap 32. The force transferring surface 54 is disposed on the lower strap 34 generally at its point of termination. A groove 76 is defined in the lower strap 34 on the side thereof adjacent the generally flat surface 48 thereof. The groove 76 extends from the force transferring surface 54 forwardly towards the nose portion 38.

The clamp member 18 of the subject embodiment is disposed in the longitudinally extending opening 42 of the upper strap 32 and does not extend through the longitudinally extending slot 30 of the mounting portion 12. The clamp member 18 includes the first surface 56 and the opposed second surface 58.

The resilient pad member 22 of the subject embodiment is generally the same as that set forth with respect to FIGS. 1 and 2 except in the subject embodiment, the resilient pad member 22 has a greater overall height. It is recognized, that the resilient pad member 22 as used in either of the embodiments could have various shapes and/or sizes without departing from the essence of the invention.

Referring to FIGS. 5, 6, and 7, an alternate embodiment of the wedge member 20 and the resilient pad member 22 is illustrated. The wedge member 20 of FIG. 5 has a groove 80 defined in the second opposed surface 64 thereof and includes a plurality of teeth 82 disposed therein. The resilient pad member 22 of FIG. 6 has a plurality of teeth 84 disposed on one side thereof and of a size sufficient to fit into the groove 80 of the wedge member 20 and engage the plurality of teeth 82 therein. The plurality of teeth 84 are preferably disposed on the non-resilient portion 68 of the resilient pad member 22. The interrelationship of the plurality of teeth 82 on the wedge member 20 and the plurality of teeth 84 on the resilient pad member 22 is clearly illustrated in FIG. 7. The interaction of the plurality of teeth 82 and the plurality of teeth 84 act to retain the wedge member 20 in its assembled position. Even though the wedge member 20 and a resilient pad member 22 is illustrated in FIG. 7 similar to the embodiment set forth in FIG. 1, it is recognized that the same relationship would hold true if the wedge member 20 and the resilient pad member 22 were utilized in the embodiment set forth in FIG. 3.

Figure 8:
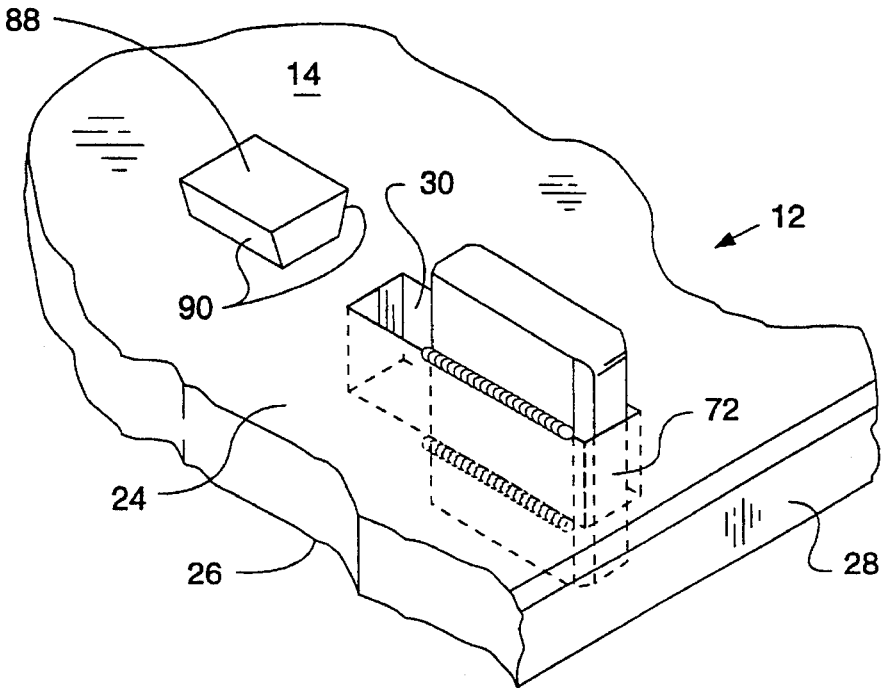
FIG. 8 is a diagrammatic representation of an alternate embodiment of the mounting portion of the implement assembly of FIG. 1.
Figure 9:
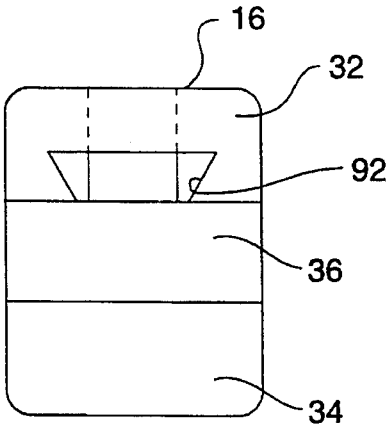
FIG. 9 is an end view of an alternate embodiment of the adapter illustrated in FIG. 3.
Figure 10:
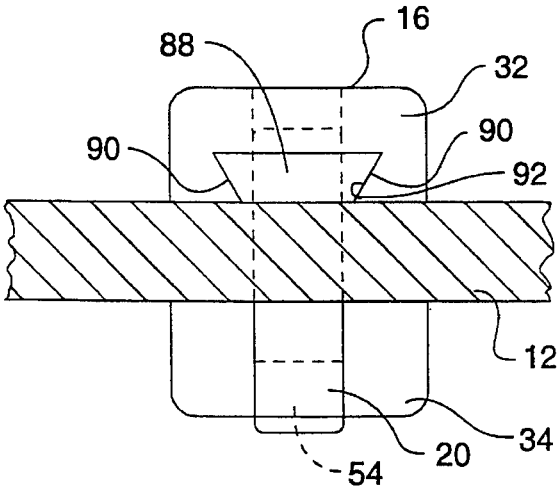
FIG. 10 is a partial sectional view of the adapter of FIG. 9 mounted on the mounting portion illustrated in FIG. 8.

Referring to FIGS. 8,9 and 10, another embodiment of the mounting portion 12 and the adapter 16 is illustrated. All like elements have like element numbers. In the subject embodiment, a block member 88 is disposed on the upper surface 24 of the mounting portion 12 and is spaced rearwardly from the longitudinally extending slot 30 therein. The block member 88 has tapered longitudinally extending sides 90 disposed thereon.

The adapter of the subject embodiment is like that set forth in FIGS. 3 and 4 plus it has a dovetail groove 92 defined in the upper strap 32 on the side thereof adjacent the generally flat surface 40 and extends from the longitudinally extending opening 40 to the rearward end thereof. The sides of the dovetail groove 92 are operative to engage the tapered sides 90 of the block member 88 on the mounting portion 12 when assembled thereon.

It is recognized that various forms of the implement assembly could be utilized without departing from the essence of the invention. For example, the first surface 44 on the upper strap 32 of the adapter 16 and its mating first surface 56 on the clamp member 18 could have varying acute angles without departing from the essence of the invention. Likewise, the dovetail groove 92 of the adapter illustrated in FIGS. 9 and the mating block member 88 could have an inverted tee shape without departing from the essence of the invention.

Industrial Applicability

In the assembly and operation of the implement assembly 10 illustrated in FIGS. 1 and 2, the adapter 16 is mounted on the mounting portion 12 of the implement 14 such that the longitudinally extending openings 42 and 50 of the adapter 16 are in alignment with the longitudinally extending slot 30 in the mounting portion 12. Subsequent to placing the adapter 16 on the mounting portion 12, the resilient pad member 22 is placed in the forward end of the longitudinally extending slot 30 between the upper strap 32 and the lower strap 34. Next, the clamp member 18 is inserted and extends through the longitudinally extending slot 42 of the upper strap, the longitudinally extending slot 30 of the mounting portion 12 and into the longitudinally extending slot 50 of the lower strap 34. Once the clamp member 18 is inserted, it is moved rearwardly until the first and third surfaces 56,60 thereof come into mating engagement with the first surface 44 of the upper strap 32 and the first surface 52 of the lower strap 34. The wedge member 20 is now inserted into the longitudinally extending opening 42 of the top strap 32, the longitudinally extending slot 30 of the mounting portion 12 and the longitudinally extending opening 50 of the lower strap 34 until the first surface 62 of the wedge member 20 contacts the second surface 58 of the clamp member 18 and the second surface 64 thereof contacts the non-resilient portion 68 of resilient pad member 22. The wedge member 20 is now forcibly driven further into the respective openings, compressing the resilient pad member 22 until the second opposed surface 64 thereof contacts the second surface 46 in the longitudinally extending opening 42 of the upper strap 32 and the force transferring surface 54 in the longitudinally extending opening 50 of the lower strap 34.

The force being generated by driving the wedge member 20 into place is transferred from the second surface 46 of the upper strap 32 and the load transferring surface 54 of the lower strap 34 through the respective first and third surfaces 56,60 of the clamp member 18 into the respective first surface 44 of the upper strap 34 and the first surface 52 of the lower strap 34. This force urges the generally flat surface 40 of the upper strap 32 and the generally flat surface 48 of the lower strap 34 into intimate contact with the respective upper and lower surfaces 24,26 of the mounting portion 12 of the implement 14.

Since the elastomeric member 66 is compressed during the installation of the wedge member 20, the force established between the wedge member 20 and the forward portion of the longitudinally extending slot 30 urges the adapter 16 rearwardly such that the interconnecting abutment surface 36 of the adapter 16 is held in intimate engagement with the leading surface 28 of the mounting portion 12.

Any movement of the adapter 16 relative to the mounting portion 12 of the implement 14 is absorbed by the resilient pad member 22. The wedge member 20 and the clamp member 18 both move in conjunction with the adapter 16, thus, there is no tendency for the wedge member 20 to move relative to the clamp member 18, consequently, reducing if not eliminating any tendency of the wedge member 20 to become loose and fall out.

In the assembly and operation of the implement assembly 10 illustrated in FIGS. 3 and 4, the longitudinally extending opening 42 in the upper strap 32 is lowered over the abutment member 72 until the generally flat surface 40 of the upper strap 32 contacts the upper surface 24 of the mounting portion 12. The adapter 16 is then moved rearwardly allowing the extending portions of the abutment member 72 to slide into the respective grooves 72,76 respectively located in the upper strap 32 and the lower strap 34. The rearward movement continues until the interconnecting abutment surface 36 of the adapter 16 contacts the leading surface 28 of the mounting portion 12. The resilient pad member 22 is now inserted into the longitudinally extending opening 42 of the upper strap 32 and lowered until the resilient pad member 22 can be moved forwardly into the respective grooves 72,76 of the upper strap 32 and the lower strap 34 until the elastomeric member 66 contacts the abutment member 72. Next, the clamp member 18 is inserted into the longitudinally extending opening 42 of the upper strap 32 until it contacts the upper surface 24 of the mounting portion 12. Subsequently, the clamp member 18 is moved rearwardly until the first surface 56 thereof contacts the first surface 44 located on the upper strap 32 in the longitudinally extending opening 42 thereof.

The clamp member 20 is now inserted into the longitudinally extending opening 42 of the upper strap 32 until the first surface 62 thereof contacts the second surface 58 of the clamp member 18 and the second surface 64 thereof contacts the non-resilient portion 68 of the resilient pad member 22. The wedge member 20 is now forcibly driven further into the longitudinally extending opening of the upper strap 32, thus, compressing the resilient pad member 22 until the second surface 64 of the wedge member 20 contacts the second surface 46 in the longitudinally extending opening 42 of the upper strap 32 and the force transferring surface 54 on the lower strap 34. The force established by the wedge member 20 between the respective second surface 46 of the upper strap 32 and the force transferring surface 54 of the lower strap 32 and the second surface 58 of the clamp member 18 is transferred to the first surface 44 of the upper strap 32 urging the generally flat surface 40 into intimate contact with the upper surface 24 of the mounting portion 12. The force established by the compression of the resilient pad member 22 reacting against the abutment member 72 is transferred from the wedge member 20 into the adapter 16 urging it rearwardly to maintain intimate contact between the interconnecting abutment surface 36 of the adapter 16 and the leading surface 28 of the mounting portion 12.

As explained with respect to the previous embodiment, any motion of the adapter 16 relative to the mounting portion 12 is absorbed by the resilient pad member 22. Likewise, as noted previously, both the wedge member 20 and the clamp member 18 move with respect to any movement of the adapter 16, consequently, reducing if not eliminating any tendency of the wedge member 20 to become loose and fall out.

In the assembly and operation of the alternate embodiments of the wedge member 20 and resilient pad member 22 illustrated in FIGS. 5–7, the assembly is identical to that set forth in the embodiment of FIGS. 1 and 2 and also the embodiments of FIGS. 3 and 4. The only difference being that when the wedge member 20 is forcibly driven into the respective openings, the plurality of teeth 82 in the wedge member 20 rachet across the respective plurality of teeth 84 in the resilient pad member 22. As can be clearly seen in FIG. 7, the wedge member 20 is further restrained from becoming loose by the interaction between the plurality of teeth 82 on the wedge member 20 and the plurality of teeth 84 on the resilient pad member 22. An additional force is required to compress the elastomeric member 66 of the resilient pad member 22 to allow the plurality of teeth 82 on the wedge member 20 to move or rachet relative to the plurality of teeth 84 on the resilient pad member 22. This relationship further insures that the wedge member 20 does not become loose and fall out.

Referring to the assembly and operation of the alternate embodiment illustrated in FIGS. 8–10, the adapter 16 is installed on the mounting portion 12 in the same manner as that described with respect to the embodiments illustrated in FIGS. 3 and 4. The only difference being that as the adapter 16 is being moved rearwardly on the mounting portion 12, the dovetail groove 92 of the upper strap 32 slips over the block member 88 such that the tapered sides 90 of the block member 88 are in close proximity to the sides of the dovetail groove 92. Consequently, any tendency of the upper strap 32 to move upwardly away from the upper surface 24 of the mounting portion 12 results in the tapered sides 90 of the block member 88 coming into contact with the sides of the dovetail groove 92 inhibiting any further movement thereof.

In view of the foregoing, it is readily apparent that the structure of the present invention provides an implement assembly 10 with a mechanically attached adapter 16 having a securing mechanism that holds the adapter in mating contact with the mounting portion 12 by using a wedge and clamp mechanism 18,20,22 while also insuring that the wedge and clamp both move with respect to the adapter 16, thus, eliminating if not totally reducing any tendency of the wedge member 20 to become loose and fall out.

Other aspects, objects, and advantages of this invention can be obtained through a study of the drawings, the disclosure and the appended claims.

We claim:

1. An implement assembly with a mechanically attached adapter, comprising:

an implement having a mounting portion with an upper surface, a lower surface, a leading surface, and a vertically oriented longitudinally extending slot defined therein spaced rearwardly from the leading surface, said slot having a forward end;

an adapter having an upper strap, a spaced apart lower strap having a force transferring surface thereon and an interconnecting abutment surface, the upper and lower straps being adapted to receive the mounting portion therebetween, the upper strap has a generally flat bottom surface on one side thereof and a vertically oriented longitudinally extending opening defined therein, a first surface is disposed on the upper strap at one end of the opening and oriented at an acute angle with respect to the generally flat bottom surface and a second surface is disposed at the other end of the longitudinally extending opening;

a clamp member disposed in the vertically oriented longitudinally extending opening and having a first surface thereon that matingly engages the first surface disposed on the upper strap at the one end of the longitudinally extending opening and a second opposed surface;

a resilient pad member disposed in the forward end of the longitudinally extending slot between the upper and lower straps of the adapter; and a wedge member having a first surface operative to matingly engage the second opposed surface of the clamp member and a second surface spaced from and angled with respect to the first surface of the wedge member and operative to contact and compress the resilient pad member during assembly to securely retain the interconnecting abutment surface in engagement with the leading surface of the mounting portion and to contact the second surface of the longitudinally extending opening in the upper strap and the force transferring surface on the lower strap, both said wedge member and said clamp member being free of direct longitudinal engagement with the longitudinally extending slot of the mounting portion such that any motion of the adapter relative to the mounting portion is absorbed through the resilient pad member.

2. The implement assembly of claim 1 wherein the wedge member has a plurality of teeth disposed on the opposed second surface thereof and the resilient pad member has a non-resilient portion on one side thereof with a plurality of teeth disposed thereon and operative to mate with the plurality of teeth on the wedge member.

3. The implement assembly of claim 1 wherein the first surface on the clamp member that matingly engages the first surface disposed on the upper strap at the one end of the opening transfers a force from the clamp member to the upper strap urging the upper strap both rearwardly to maintain the interconnecting abutment surface on the adapter in intimate engagement with the leading surface of the mounting portion of the implement and downwardly to maintain the generally flat bottom surface of the upper strap in intimate engagement with the upper surface of the mounting portion of the implement.

4. The implement assembly of claim 3 wherein the resilient pad member has a non-resilient portion on one side thereof in sliding contact with the second surface of the wedge member.

5. The implement assembly of claim 4 wherein the lower strap has a generally flat top surface on one side thereof and a vertically oriented longitudinally extending opening defined therein, a first surface is disposed on the lower strap at one end of the opening therein and oriented at an acute angle with respect to the generally flat surface thereof and the force transferring top surface is disposed at the other end of the opening therein, and the clamp member extends through the vertically oriented longitudinally extending slot and into the vertically oriented longitudinally extending opening in the lower strap and has a third surface thereon in mating engagement with the first surface disposed on the lower strap at the one end of the opening therein.

6. The implement assembly of claim 4 wherein a groove is defined in the upper strap on the side thereof adjacent the generally flat bottom surface and forward of the longitudinally extending opening therein, an abutment member is disposed in the longitudinally extending slot between the forward end of the slot and the resilient pad member and extends upwardly from the top surface of the mounting portion into the groove in the upper strap.

7. The implement assembly of claim 6 wherein a groove is defined in the lower strap on the side thereof adjacent the generally flat top surface thereof and the abutment member extends downwardly into the groove in the lower strap.

8. The implement assembly of claim 7 wherein the mounting portion of the implement has a block member with tapered sides secured to the upper surface thereof at a location spaced rearwardly from the vertically oriented longitudinally extending slot and the upper strap of the adapter has a dovetail groove defined therein located rearwardly of the longitudinally extending opening and has tapered sides that matingly engage the tapered sides of the block member on the mounting portion of the implement.

* * * * *